United States Patent [19]

Bradford

[11] Patent Number: 4,970,739

[45] Date of Patent: Nov. 20, 1990

[54] STRETCHER

[76] Inventor: John G. Bradford, 144 McNiven Rd., Ancaster, Ontario, Canada, L9G 3L1

[21] Appl. No.: 451,082

[22] Filed: Dec. 15, 1989

[51] Int. Cl.[5] ..... A61G 1/00; A61G 1/04; A61G 1/044

[52] U.S. Cl. ..... 5/82 R; 128/870

[58] Field of Search ..... 5/82 R, 434, 436; 128/869, 870, 871

[56] References Cited

U.S. PATENT DOCUMENTS

| | | | |
|---|---|---|---|
| 1,270,107 | 6/1918 | Boardman | 5/82 R |
| 2,489,828 | 11/1949 | Springer | 5/82 R |
| 2,788,530 | 4/1957 | Ferguson | 5/82 R |
| 2,899,692 | 8/1959 | Finken | 5/82 R |
| 3,158,875 | 12/1964 | Fletcher | 5/82 R |
| 3,361,132 | 1/1968 | Rentsch | 5/82 R |
| 3,426,367 | 2/1969 | Bradford | 5/82 R |
| 3,469,268 | 9/1969 | Phillips | 5/82 R |
| 3,601,824 | 8/1971 | Bradford | 5/82 R |
| 3,886,606 | 6/1975 | Bradford | 5/82 R |
| 4,034,748 | 7/1977 | Winner | 5/82 R |
| 4,124,908 | 11/1978 | Burns et al. | 5/82 R |
| 4,211,218 | 7/1980 | Kendrick | 5/82 R |
| 4,601,075 | 7/1986 | Smith | 5/82 R |
| 4,655,206 | 4/1987 | Moody | 5/82 R |

*Primary Examiner*—Alexander Grosz

*Attorney, Agent, or Firm*—Ridout & Maybee

[57] ABSTRACT

A stretcher for conveying a patient in an immobilized condition has a body support within a perimeter frame, and elongated flaps connected to the body support to define a tapering body support zone between the flaps. The upper side of one flap and the underside of the other flap each carry several parallel strips of hooked pile fabric, extending in perpendicular directions on the two flaps, so that by folding the flaps across, the patient can be immobilized in a tube formed by the body support member and the flaps. Longitudinal restraint is provided to shoulder and foot straps, free ends of which are secured by being laid between the flaps. An auxiliary pelvic harness may be used, and a head restraint is provided.

11 Claims, 3 Drawing Sheets

STRETCHER

BACKGROUND OF THE INVENTION

1. Field of the Invention

This invention relates to stretchers for conveying patients, particularly under adverse conditions in which adequate restraint and protection of a patient must be combined.

2. Review of the Art

Various proposals have been made for stretchers in which patients can be conveyed out of difficult locations, during which the patient must be held immobile regardless of the attitude of the stretcher so as to avoid aggravating existing injuries. A problem in designing such stretchers is to provide effective restraints which can nevertheless be readily and quickly applied and removed even under very adverse conditions.

Typical examples of known stretchers of this type are disclosed in (Boardman) U.S. Pat. No. 1,270,107, (Ferguson) U.S. Pat. No. 2,788,530 and (Fletcher) U.S. Pat. No. 3,158,875, and in my own U.S. Pat. Nos. 3,426,367; 3,601,824 and 3,886,606. Such stretchers typically provide some form of frame or cage (in the case of the Fletcher patent merely longitudinal strut), supporting a canvas or similar sheet on or within which the patient is immobilised by a more or less complex system of straps and flaps which will often need to be applied and possibly released in circumstances under which correct handling of a complicated array of straps and buckles will be slow and difficult, even after extensive training.

Proposals have been made for patient restraint devices in which interengaging hooked pile fabric are utilized to facilitate application of the restraint to a patient. Examples are disclosed in U.S. Pat. Nos. 3,361,132 (Rentsch), 3,469,268 (Phillips) and 4,034,748 (Winner). The Rentsch device is in effect a straightjacket using hooked pile fastenings of the jacket and its shoulder straps. The other two patent show rigid fracture boards to which the head and torso of a patient is secured by means of straps using hooked pile fabric fasteners. Whilst undoubtedly easier to apply than conventional belt and buckle type straps, the interengaging areas of hooked pile fabric must be correctly aligned with one another, and misalignment will prejudice the security of the fastenings obtained, which are dependent upon a sufficient area of interengagement of patches of hooked pile fabric.

SUMMARY OF THE INVENTION

An object of the present invention is to provide a stretcher having patient immobilization means which can be applied and removed very easily and rapidly, yet provide a high degree of patient security.

A stretcher according to the invention comprises: a rigid perimeter frame; an elongated body support member of size sufficient to support a human body, supported within the perimeter frame; first and second elongated flexible flaps each attached at one longitudinal edge to an upper surface of said body support so as to define between said attached longitudinal edges a body support zone longitudinally tapering towards one end, said flaps having sufficient lateral extent to envelop major portions of the torso and legs of a human body placed on said body support zone, with the flaps overlapping over substantially the whole of a side of the body opposite that contacting the body support zone; plural strips of hooked pile fabric attached to an upper surface of the overlapping portion of one flap and a lower surface of the overlapping portion of the other flap, the strips being arranged so that when the flaps are overlapped, the strips of the two flaps extend in substantially perpendicular relationship; and foot and shoulder straps attached in their one ends to opposite ends of said body support zone, the straps being long enough to engage feet and shoulders of a patient and thereafter substantially overlap said overlapping portion of the flap;

whereby by placing the first flap over a body on the support zone, laying the other ends of the foot and shoulder straps over the first flap after passing them around feet and shoulders of the body, and placing the second flap over the first flap and the straps so that the strips of hooked pile fabric interengage, a patient can be securely immobilized on the support zone.

Preferably a pelvic harness is provided for securing a body to the body support member within and independently of the flaps. The perimeter frame may be a tubular frame or a basket, and this harness may be directly connected to the latter. A supplementary harness to immobilize a patient's head is preferably also provided. Finally, auxiliary external straps may be provided for fastening around the exterior of the flaps to prevent the second flap being accidentally pulled away from the first flap during handling of the stretcher.

Further features of the invention will be apparent from the following description of a preferred embodiment of the invention.

IN THE DRAWINGS

Figure 2:
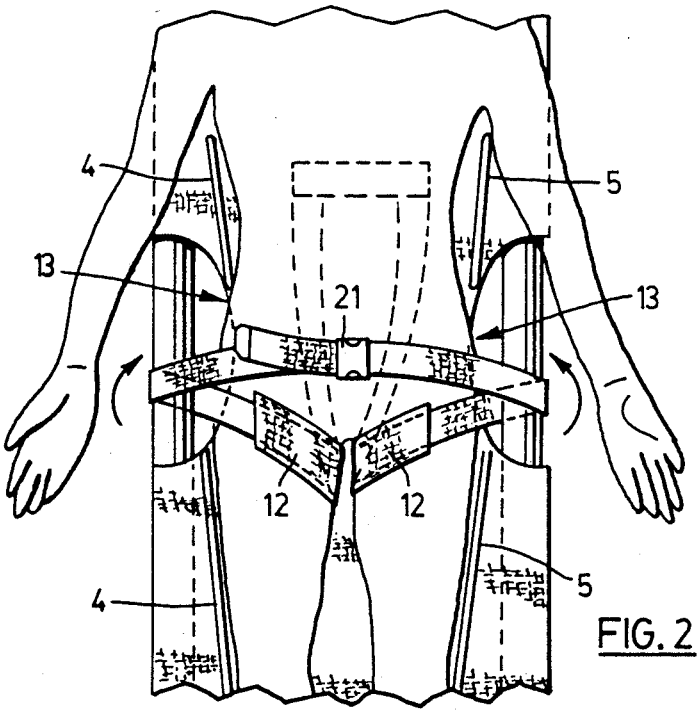
FIG. 2 is fragmentary plan view showing a first stage in the immobilization of a patient.
Figure 4:
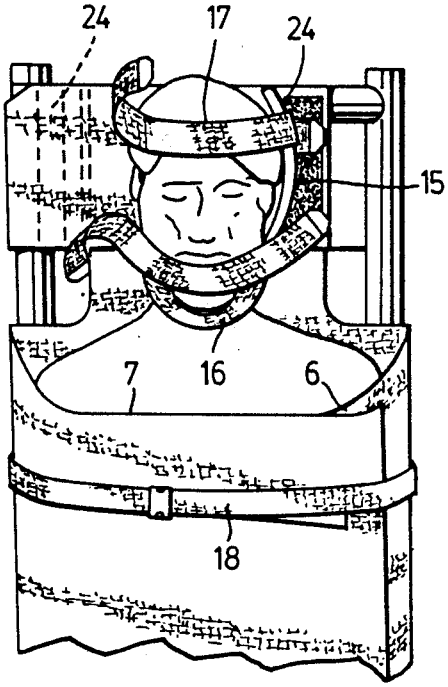

FIG. 4 found on the same sheet as FIG. 2, is a fragmentary plan view showing how the head of the patient is immobilized.

The stretcher shown in the Figures has a rectangular tubular frame 1, which may be constructed for example in accordance with my U.S. Pat. No. 3,886,606. The construction, of the frame however forms no part of the present invention, and it may be of any alternative construction, for example a basket litter, which is suited to the application and which both provides some protection to the patient during travelling and a rigid perimetric support for a body support member or litter 2 stretched between or within the frame structure. Indeed, the frame and the litter could be integrated as a rigid board.

The body support member 2 has a longitudinal central body support zone 3, tapering towards one end and defined between seams 4, and 5 at which are attached two longitudinally extending flexible flaps 6 and 7 which are securely fastened to the body support member 2 at the seams 4 and 5. The flap 6 is provided on its underside (which is shown partly folded over in FIG. 1 so that it can be seen) with a number of parallel laterally expanding strips 8 of hooked pile fabric, such as that sold under the trade-mark VELCRO, whilst the flap 7 is equipped on its upper surface . with a number of parallel longitudinally extending strips 9 of hooked pile fabric adapted to enter fastening relationship with the strips 8. The exact orientation of these strips is not critical, but the strips on one flap should be generally parallel and at a substantial angle to the strips on the other flap so as to have a sufficient perpendicular extent to provide multiple crossings between the strips on the two flaps when the flaps are overlapped, even when the degree of overlap varies. Whilst the arrangement described is the simplest way of achieving such multiple crossings, other functionally equivalent arrangements of the hooked pile fabric on the flaps are within the scope of my invention.

At one end of the zone 3 are attached two elongated shoulder straps 10, whilst near the opposite tapered end of the member 2, beyond the zone 3, are attached two elongated foot straps 11. Releasably attached to a centre portion of the zone 3 is a pelvic harness consisting of two straps 12. Two apertures 13 are formed at the seams 4 and 5 for passage of these straps. A head support comprises a central pad 14 and padded side flaps 15, provided on their underside with parallel longitudinal strips 24 of hooked pile fabric across which can be applied chin and head straps 16 and 17 (see FIG. 4) similarly equipped with mating hooked pile fabric. Further straps 18 and 19 are secured to the frame at longitudinally spaced locations.

Figure 1:
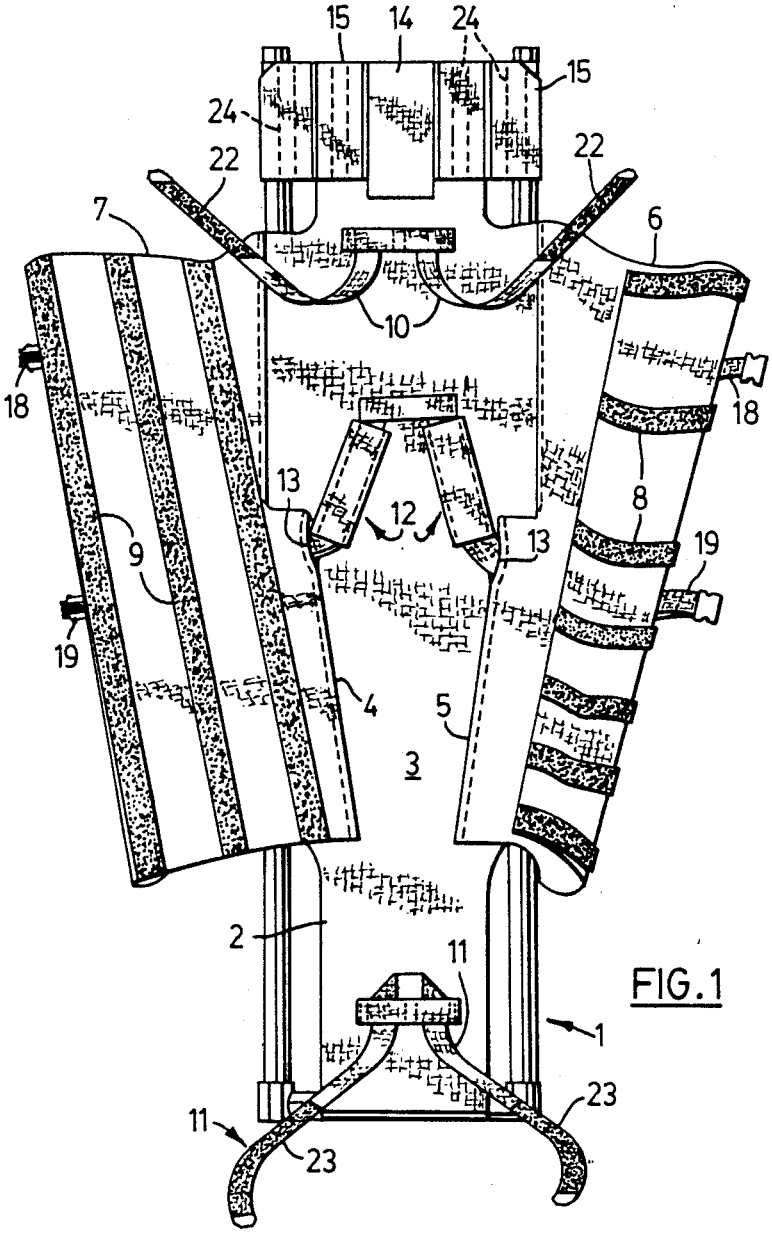
FIG. 1 is a plan view of a stretcher in accordance with the invention, with the various parts spread out preparatory to a patient.

In use, the stretcher is put in a condition substantially as shown in FIG. 1, and a patient is placed on the zone 3. The portion of this zone at least to one end of the aperture 13 is tapered by causing the seams 4 and 5 to converge, thus matching the natural convergence of the legs of the human body. To the other end of the apertures 13, the seams are generally parallel.

If utilized, the straps 12 forming the pelvic harness are then passed over the thighs of the patient, through the apertures 13, around side members 20 of the frame 1, back through the aperture 13, before being fastened to one another around the waist of the patient by means of either a buckle 21 or hooked pile fabric strips. This is illustrated in FIG. 2, in which the flaps 6 and 7 have been omitted for clarity. Such a harness if provided permits traction to be applied to either leg of the patient in the event that the patient has sustained a leg fracture.

Figure 3:
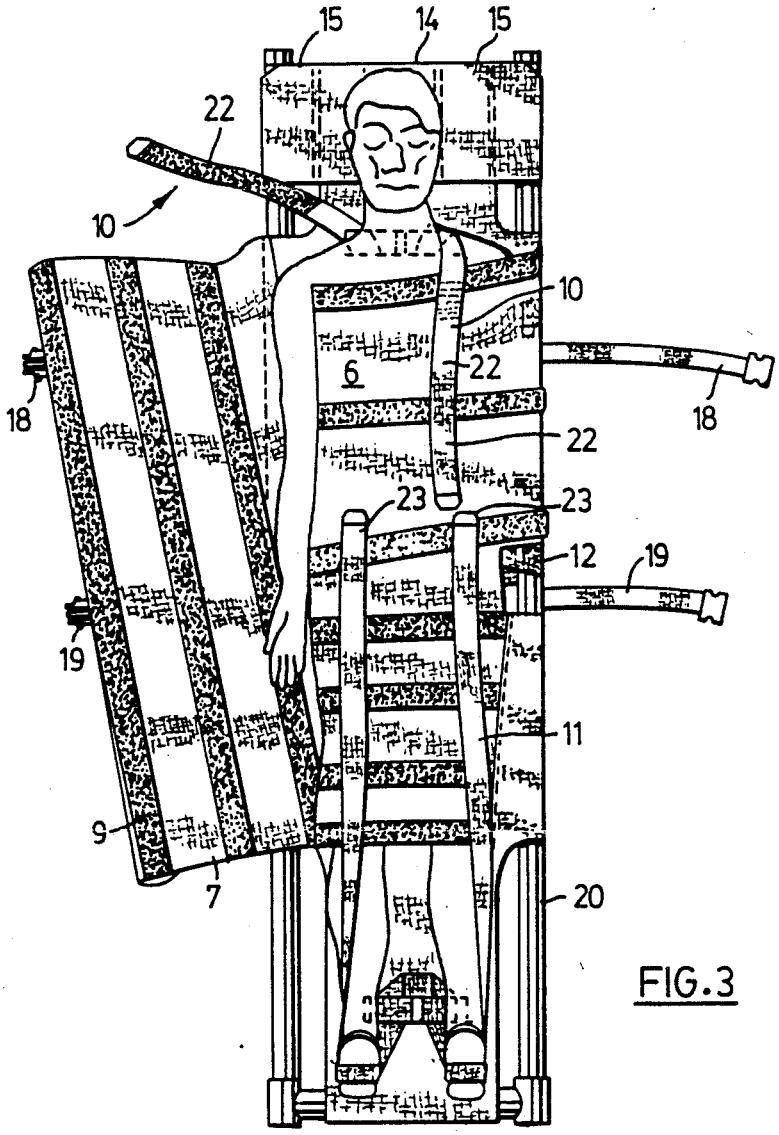
FIG. 3 is a plan view showing a later stage in immobilization.

The flap 6 is then wrapped over the body of the user. This flap is dimensioned so that, with a patient of average height, it extends up to the shoulders and down below the knees, and wraps entirely across the front of the body (see FIG. 3). The shoulder straps 10, end portions of which themselves have hooked pile fabric 22 attached to both sides are then passed over the shoulders of the patient and their free ends placed on the flap 6, where the hooked pile fabric on them engages the lateral strips 8 of hooked pile fabric on the flap 6. Similarly, the foot straps 11 are secured around the feet of the patient, and their ends, also provided on both sides with strips of hooked pile fabric 23, are laid on the flap 6.

Thereafter, the flap 7 is wrapped over the flap 6, (see FIG. 4) such that the strips 9 engage the strips 8, and also the hooked pile fabric strips on the upper side of the straps 10 and 11, thus firmly securing the flaps and straps, and immobilizing the patient within the tube formed by the support 2 and the flaps 6 and 7. As well as the patient, such devices as fracture boards or splints may be located within this tube, and appliances attached to the patient such as inflatable splints can also be accommodated. If one or both arms of the patient must be accessible, for example for application of IV apparatus, the appropriate flap may be wrapped under rather than over the arm concerned. To avoid the flap 7 from being inadvertently pulled away from the flap 6, the straps 18 and 19 are secured around the patient, as shown in FIG. 4.

In order to immobilize and support the head of the patient, the side flaps 15 are pulled up and secured by applying the straps 16 and 17 (see FIG. 4). The undersides (as seen in Figure of the flaps 15 are equipped with multiple strips 24 of hooked pile fabric extending generally perpendicular to the strips applied to the straps 16 and 17.

Many hooked pile fabrics systems consist of two different complementary types of fabric designed for optimum adhesion; typically the pile fibres on one type are formed with hooked ends and the pile fibres on the other type with enlarged bulbous ends which are engaged by the hooks. If such a fabric system is used, then appropriate complementary fabrics should be applied to parts intended to enter fastening engagement.

It will be appreciated that the system described, apart from the optional harness 12, and straps 18 and 19, can be very easily and quickly operated to immobilize and also to wholly or partially release a patient since the system merely requires the flap 6 to be wrapped over the patient, the straps 10 and 11 to be passed around the shoulders and feet and laid on the flap 6, and the flap 7 to be wrapped over the flap 6. There is no criticality of alignment, and good engagement between the parts is assured.

I claim:

1. A stretcher comprising:

a rigid perimeter frame;

an elongated body support member of size sufficient to support a human body, supported within the perimeter frame;

a first elongated flexible flap and a second elongated flexible flap each attached along one longitudinal edge to an upper surface of said body support so as to define between said attached longitudinal edges a body support zone longitudinally tapering towards one end, said flaps having sufficient lateral and longitudinal extent to continuously envelope most of the torso and legs of a human body placed on said body support zone, with the flaps overlapping over substantially the whole length and width of a side of the enveloped portion of the body opposite that side contacting the body support zone;

plural strips of hooked pile fabric attached to an upper surface of and distributed over the whole of the overlapping portion of one flap and attached to a lower surface of and distributed over the whole of the overlapping portion of the other flap, the strips being arranged so that when the flaps are overlapped, the strips of the two flaps extend in substantially perpendicular relationship and interengage in a multitude of locations distributed over the whole area of overlap between the flaps; and shoulder straps attached at their one ends to the body support member adjacent the end remote from the tapered end of said body support zone, the straps being long enough to engage shoulders of the body and thereafter extend between said overlapping portions of the flap, said straps having surfaces grippingly engageable by the strips of hooked pile fabric on said flaps;

whereby by wrapping the first flap over the body on the support zone, laying the other ends of the shoulder straps over the first flap after passing them around shoulders of the body, and wrapping the second flap over the first flap and the straps so that the strips of hooked pile fabric interengage but each other and the straps, the body can be securely immobilized on the support zone within a tapered tube formed by said support zone and said overlapped flaps, within which the body is further retained by the shoulder straps grippingly engaged between the strips of hooked pile fabric on the flaps.

2. A stretcher according to claim 1, further including a pelvic harness for securing a patient's pelvis to the body support member within and independently of the flaps.

3. A stretcher according to claim 2, wherein the pelvic harness comprises two straps anchored at their one ends to the body support member midway between the attached longitudinal edges of the flaps, for passage over the thighs of the body, through apertures defined between the longitudinal edges of the flaps and the body support member, around longitudinal side members of the perimeter frame, and back through the apertures, the straps being securable to one another above a pelvic region of the body.

4. A stretcher according to claim 1, wherein the perimeter frame is a tubular rectangular frame.

5. A stretcher according to claim 1, further including external straps for securing around the body support member and the flaps to prevent unwrapping of the latter.

6. A stretcher according to claim 1, further including means attached to the body support member for immobilizing a patient's head.

7. A stretcher according to claim 6, wherein the head immobilizing means comprise side flaps attached to the body support member for engaging the sides of the head, and brow and chin straps for engaging the head at brow and chin, the straps having strips of hooked pile fabric extending longitudinally of end portions of the straps, and the side flaps having strips of hooked pile fabric extending generally parallel to a longitudinal axis of the stretcher and generally perpendicular to the strips on the chin and brow straps.

8. A stretcher according to claim 1, wherein end portions of the foot and shoulder straps engageable with the flaps carry longitudinal strips of hooked pile fabric.

9. A stretcher according to claim 1, wherein the plural strips of hooked pile fabric attached to said other flap include a strip attached immediately adjacent substantially the full length of its free longitudinal edge.

10. A stretcher comprising:

a rigid perimeter frame;

an elongated body support member of size sufficient to support a human body, supported within the perimeter frame; a first elongated flexible flap and a second elongated flexible flap each attached at one longitudinal edge to an upper surface of said body support so as to define between said attached longitudinal edges a body support zone longitudinally tapering towards one end, said flaps having sufficient lateral extent to envelop major portions of the torso and legs of a human body placed on said body support zone, with the flaps overlapping over substantially the whole of a side of the body opposite that contacting the body support zone;

plural strips of hooked pile fabric attached to an upper surface of the overlapping portion of one flap and a lower surface of the overlapping portion of the other flap, the strips being arranged so that when the flaps are overlapped, the strips of the two flaps extend in substantially perpendicular relationship;

foot and shoulder straps attached at their one ends to opposite ends of said body support zone, the straps being long substantially overlap said overlapping portion of the flap, end portions of the foot and shoulder straps engageable with the flaps carrying longitudinal strips of hooked pile fabric; and head immobilizing means attached to the body support member for immobilizing a patient's head, said head immobilizing means comprising side flaps attached to the body support member for engaging the sides of the head, and brow and chin strips for engaging the head at brow and chin, the straps having strips of hooked pile fabric extending longitudinally of end portions of the straps and the side flaps having strips of hooked pile fabric extending generally parallel to a longitudinal axis of the stretcher and generally perpendicular to the strips on the chin and brow straps;

whereby by placing the first elongated flexible flap over a body on the support zone, laying the other ends of the foot and shoulder straps over the first flap after passing them around feet and shoulders of the body, and placing the second flap over the first flap and the straps so that the strips of hooked pile fabrics interengage a patient can be securely immobilized on the support zone.

11. A stretcher comprising;

a rigid perimeter frame;

an elongated body support member of size sufficient to support a human body, supported within the perimeter frame;

a first elongated flexible flap and a second elongated flexible flap each attached along one longitudinal edge to an upper surface of said body support so as to define between said attached longitudinal edges a body support zone longitudinally tapering towards one end, said flaps having sufficient lateral and longitudinal extent to continuously envelop most of the torso and legs of a human body placed on said body support zone, with the flaps overlapping over substantially the whole length and width of a side of the enveloped portion of the body opposite that side contacting the body support zone so as to form with said body support zone a tapered tube closely wrapping at least the torso and upper legs of said human body;

plural strips of hooked pile fabric attached to and distributed over an upper surface of substantially the whole overlapping portion of one flap and a low surface of substantially the whole overlapping portion of the other flap, the strips being arranged so that when the flaps are overlapped, the strips of the two flaps extend in substantially perpendicular relationship and interengage in a multitude of locations distributed over the area of overlap, the plural strips of hooked pile fabric attached to said lower surface of the other flap including a strip attached immediately adjacent substantially the full length of its free longitudinal edge;

means attached to the body support member for immobilizing the patient's head; and foot and shoulder straps attached at their one end to opposite to engage feet and shoulders of the body and thereafter extend substantially between said overlapping portion of the flaps, said straps having surfaces grippingly engageable by hooked pile fabric on said flaps;

whereby by wrapping the first flap over the body on the support zone, laying the other ends of the foot and shoulder straps over the first flap after passing them around feet and shoulders of the body, and wrapping the second flap over the first flap and the straps so that the strips of hooked pile fabric engage each other and the straps, the body can be securely immobilized on the support zone within the tube formed by said support zone and said flaps, within which the body is further retained by the shoulder straps.

* * * * *